US007676980B2

(12) United States Patent
Bender

(10) Patent No.: US 7,676,980 B2
(45) Date of Patent: Mar. 16, 2010

(54) ADJUSTABLE MASS TUNER FOR RIFLE BARRELS

(76) Inventor: Terrence Dwight Bender, 5250 Annapolis Ln. N., Plymouth, MN (US) 55446

( * ) Notice: Subject to any disclaimer, the term of this patent is extended or adjusted under 35 U.S.C. 154(b) by 0 days.

(21) Appl. No.: 12/180,127

(22) Filed: Jul. 25, 2008

(65) Prior Publication Data

US 2009/0025268 A1 Jan. 29, 2009

Related U.S. Application Data

(60) Provisional application No. 60/961,948, filed on Jul. 25, 2007.

(51) Int. Cl.
*F41C 27/22* (2006.01)
*F41A 21/38* (2006.01)

(52) U.S. Cl. ..... 42/97; 89/14.3

(58) Field of Classification Search ..... 42/97, 42/1.06; 89/14.3, 198
See application file for complete search history.

(56) References Cited

U.S. PATENT DOCUMENTS

| | | | | | |
|---|---|---|---|---|---|
| 2,073,755 | A * | 3/1937 | Poate | 42/1.06 |
| 2,302,699 | A * | 11/1942 | Klipsch | 42/97 |
| 2,444,910 | A * | 7/1948 | Barker | 89/14.3 |
| 2,921,396 | A * | 1/1960 | Larson | 42/97 |
| 3,604,136 | A * | 9/1971 | Edwards | 42/97 |
| 3,619,925 | A * | 11/1971 | Martin et al. | 42/97 |
| 3,726,037 | A * | 4/1973 | Wolff | 42/40 |
| 3,732,778 | A * | 5/1973 | Bettermann et al. | 89/14.05 |
| 4,920,854 | A * | 5/1990 | Scanlon | 89/14.4 |
| 5,279,200 | A | 1/1994 | Rose | |
| 5,505,118 | A * | 4/1996 | Arnesen et al. | 89/14.3 |
| 5,661,255 | A | 8/1997 | Webb, III | |
| 5,698,810 | A | 12/1997 | Rose | |
| 5,794,374 | A | 8/1998 | Crandall | |
| 5,798,473 | A | 8/1998 | Roblyer et al. | |
| 5,860,242 | A | 1/1999 | O'Neil | |
| 5,907,921 | A | 6/1999 | Rose et al. | |
| 6,167,794 | B1 | 1/2001 | Kathe | |
| 6,457,274 | B2 | 10/2002 | Smith | |
| 6,578,462 | B1 * | 6/2003 | Franchino et al. | 89/14.3 |
| 6,971,202 | B2 | 12/2005 | Bender | |
| 7,143,680 | B2 | 12/2006 | Bender | |
| 2006/0011056 | A1 * | 1/2006 | Edwards et al. | 89/14.3 |

OTHER PUBLICATIONS

Long, C., "Shock Wave Theory-Rifle Internal Ballistics, Longitudinal Shock Waves, and Shot Dispersion", 2004, p. 1-9.
U.S. Appl. No. 60/961,948, filed Jul. 25, 2007 Inventor: Terrence Bender.

* cited by examiner

*Primary Examiner*—Bret Hayes
(74) *Attorney, Agent, or Firm*—Vidas, Arrett & Steinkraus, P.A.

(57) ABSTRACT

An apparatus for mass-tuning a gun barrel comprises a body portion configured for attachment to the gun barrel. The body portion includes a main bore therethrough and defines a plurality of predetermined mass attachment locations. Each mass attachment location comprises a mating portion configured to engage a complimentary mating portion of a mass attachment. In some embodiments, mass attachments can be used to configure the total mass of the device.

22 Claims, 7 Drawing Sheets

ADJUSTABLE MASS TUNER FOR RIFLE BARRELS

CROSS-REFERENCE TO RELATED APPLICATIONS

This application claims priority from U.S. Provisional Application No. 60/961,948, filed Jul. 25, 2007, the entire disclosure of which is hereby incorporated herein by reference.

BACKGROUND OF THE INVENTION

This invention relates generally to a tuning system for firearms and more particularly to an adjustable mass tuning system for firearm barrels.

The precision of targeting a rifle can depend on a number of variables, such as the ability of the shooter/operator; the quality of the rifle; the caliber and quality of the ammunition; and the quality of the optical sighting systems. The precision of targeting the rifle can be measured as the rifle's ability to place repeated bullet shots within a known grouping size. The grouping size is typically measured in minutes of angle, or MOA, at a standard distance from the shooter, such as 100 yards. A rifle capable of one (1) MOA will repeatedly place shots in a 1-inch diameter circle at 100 yards, or 2-inches at 200 yards, etc.

Some rifle designs are inherently more precise than others. One factor that impacts precision is barrel dynamics, and a rifle with superior barrel dynamics can be more consistently accurate that an otherwise equivalent rifle with lesser barrel dynamics. The stiffer the barrel, the less it will distort and deviate from its initial aim point as a bullet is fired. A higher barrel stiffness generally requires a higher barrel mass; however, it is generally desirable for a high-powered rifle to be as light as possible. Thus, barrel stiffness is often limited by practical consideration in the rifle design.

To provide higher accuracy with lighter barrels, some shooters have experimented by modifying the powder loads of their ammunition in an attempt to time the exit of the bullet from the barrel muzzle to coincide with the barrel muzzle's lowest dynamic displacement. This method generally requires customized ammunition optimized for the specific firearm being used. Commercially available ammunition will typically not match the specifics required of the customized ammunition.

In an attempt to allow a given firearm to be tuned according to different ammunition, such as commercially available ammunition from multiple manufacturers, some shooters have developed dynamic tuning systems. One example is disclosed in U.S. Pat. No. 5,279,200 to Rose, which includes a moveable weight secured to the end of a gun barrel. The weight can be moved axially along the barrel to change damping characteristics and match the system to the ammunition.

Although Rose discusses damping characteristics and determining a "sweet spot" location, damping does not intrinsically alter the resonance vibration frequencies but only accelerates decay of the harmonic's amplitude. Further, the lateral displacement frequency is much lower than the longitudinal mode of barrel vibration by orders of magnitude and whose period is much too long be the cause of target aim diversion. In any case, the bullet muzzle exit event occurs over a time window much smaller than the highest frequency mode of barrel displacement. Therefore, it appears that damping is not the operative mechanism that improves rifle precision.

There remains a need for a robust mass tuning system for a firearm barrel that is highly adjustable, which can be set to a particular configuration that will not deviate over time and/or as the firearm is used repeatedly. There further remains a need for a mass tuning system that is uncomplicated for the end user.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an apparatus for mass-tuning a gun barrel comprises a body portion having a main bore therethrough and defining a plurality of predetermined mass attachment locations. Each mass attachment location comprises a mating portion configured to engage a complimentary mating portion of a mass attachment.

In some embodiments, mass attachments can be used to configure the total mass of the device. Mass attachments of varying mass, shape density, etc. can be used, and the total mass of the device can be adjusted without changing the shape or relative location of the device.

In some embodiments, a body portion can comprise a plurality of cavities, and each cavity can receive a mass attachment.

In some embodiments, a body portion can comprise at least one projection, and mass attachments can be positioned around the body portion in contact with the projection.

In some embodiments, the device comprises a plurality of interchangeable mass attachments, wherein the mass attachments are different from one another but configured to be attached to a similar mating portion.

In some embodiments, the device comprises more mass attachments than mass attachment locations.

These and other embodiments, which characterize the invention, are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
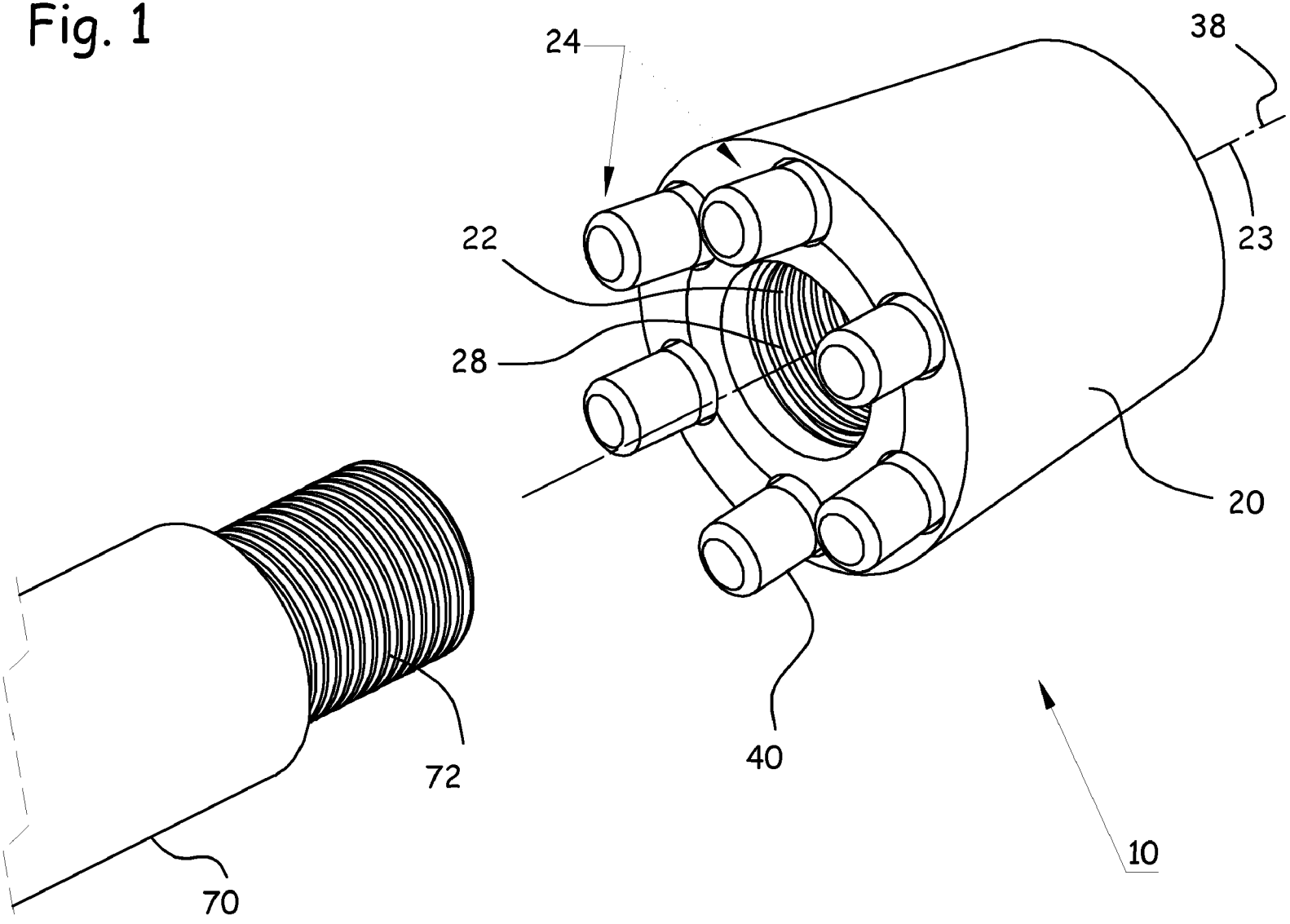
FIG. 1 shows an embodiment of a mass tuning device.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
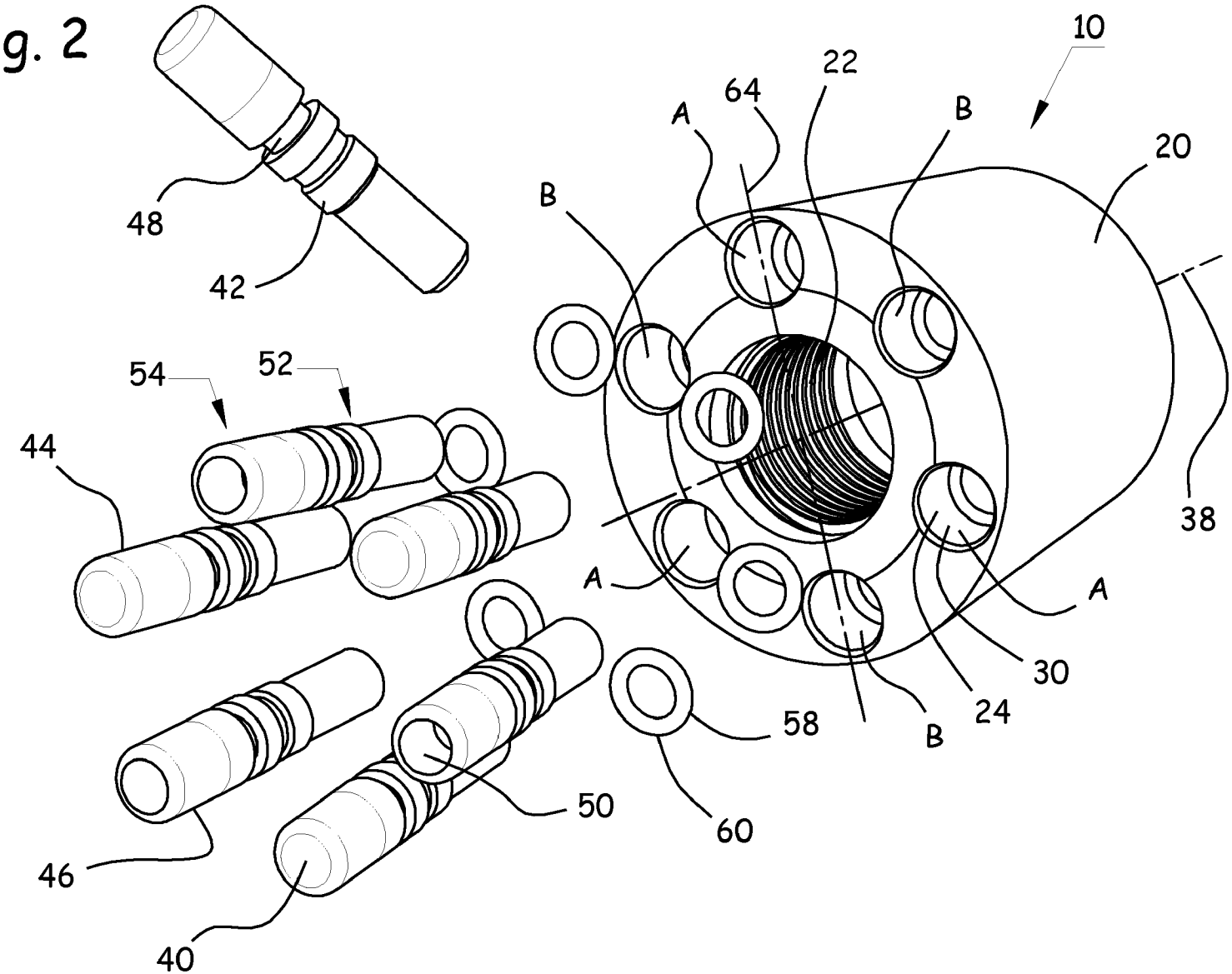
FIG. 2 shows an exploded view of an embodiment of a mass tuning device.

FIGS. 1 and 2 each show an embodiment of an adjustable mass tuning device 10. The device 10 generally comprises a body portion 20 having a bore 22 therethrough. The body portion 20 further defines a plurality of predetermined mass attachment locations 24. Each mass attachment location 24 is configured to optionally receive and engage a mass attachment/weight 40. The mass attachment locations 24 are not in fluid communication with the bore 22. The device can be used with a firearm, such as a rifle, to increase the precision of the rifle by matching the total mass of the device 10 to the ammunition being used. An example of a firearm is disclosed in U.S. Pat. No. 6,971,202, the entire disclosure of which is hereby incorporated herein by reference.

The device 10 is configured for attachment to the barrel 70 of a firearm, wherein the bore 22 is in fluid communication with a bore of the barrel 70. Thus, when the firearm is used to fire a bullet, the bullet will travel down the barrel 70 and through the bore 22 of the mass tuning device 10. Any suitable engagement mechanism can be used to secure the device 10 to a barrel 70. For example, an annular retention feature such as threads 28 that can engage complimentary threads 72 on the barrel 72 can be used, a clamping mechanism, etc. In some embodiments, threads 28 can be formed on the body portion 20, for example on a wall surface of the bore 22. In some embodiments, a central axis 23 of the bore 22 can be coaxially aligned with a central axis of the barrel 70.

In some embodiments, a central axis 23 of the bore 22 also comprises a central axis 38 of the body portion 20. In some embodiments, the body portion 20 is annular in shape and can be symmetrical across the central axis 38.

FIG. 2 shows an embodiment of a body portion 20 wherein each mass attachment location 24 comprises a cavity 30. Each cavity 30 is configured to receive a mass attachment 40 of a predetermined shape. At least a portion of a mass attachment 40 can be oriented within each cavity 30. The mass attachment locations 24/cavities 30 are desirably not in fluid communication with the bore 22.

The device 10 can comprise any suitable number of mass attachment locations 24. Although an odd number of mass attachment locations 24 can be used, an even number of mass attachment locations 24 allows for greater symmetry in the device 10. Desirably, the mass attachment locations 24 are symmetrical across a vertical axis 64, and are thus symmetrical with respect to a gravity vector. Odd numbers of mass attachment locations 24 can be symmetrical across a vertical axis 64, for example when one mass attachment location 24 is centered on the vertical axis 64. For example, although the body portion 20 in FIG. 2 includes six mass attachment locations 24, it can also be described as having two sets (A, B) of three mass attachment locations 24, wherein each set of three (A, B) is symmetrical across a vertical axis. For example, in set A, the uppermost mass attachment location 24 is centered on the vertical axis, and the lower two mass attachment locations 24 are symmetrical with one another across the vertical axis. When an even number of mass attachment locations 24 are used, each mass attachment location 24 can be symmetrical with respect to another mass attachment location 24 across the central axis 38 of the body portion 20. Thus, the device 10 can be configured to have two, three, four, five, six, seven or eight or more mass attachment locations 24. A higher number of mass attachment locations 24 provides for a greater degree of mass tuning, as described below.

In some embodiments, the mass attachment locations 24 are distributed around the central axis 38 of the body portion 20. In some embodiments, the mass attachment locations 24 are equally distributed around the central axis 38 of the body portion 20.

In some embodiments, the device 10 comprises a plurality of mass attachments 40. Each mass attachment 40 can be positioned at/in/on one of said mass attachment locations 24.

In some embodiments, the mass attachments 40 can comprise at least one first mass attachment 44 and at least one second mass attachment 46, wherein a first mass attachment 44 is different from a second mass attachment 46. The first 44 and second 46 mass attachments 40 can differ in mass, shape, size, density, etc. In some embodiments, a first mass attachment 44 comprises a greater mass than a second mass attachment 46. In some embodiments, first 44 and second 46 mass attachments 40 can have a similar shape and be made from materials having different densities. In some embodiments, first 44 and second 46 mass attachments 40 can have a similar outer profile but different masses due to shaping of the material used to form the mass attachments 40. For example, FIG. 2 shows first 44 and second 46 mass attachments 40 that have a similar profile; however, the second mass attachments 46 comprise a cavity 50, which reduces the mass.

In some embodiments, first 44 and second 46 mass attachments 40 can each comprise a first portion 52 and a second portion 54, wherein the first portions 52 are similar and the second portions 54 are dissimilar in mass, size, shape, density, etc. For example, the similar first portions 52 can be configured to engage similar mass attachment locations 24, so first 44 and second 46 mass attachments 40 can be used interchangeably at a given mass attachment location 24.

In some embodiments, the device 10 can be provided with a plurality of first mass attachments 44 at least equal to the number of predetermined mass attachment locations 24, and a plurality of second mass attachments 46 at least equal to the number of predetermined mass attachment locations 24. Thus, the device can be configured to have many combinations of mass attachments 40. For example, the device 10 could be set at a first total mass by using a first mass attachment 44 at each predetermined mass attachment location 24. The device 10 could be set at a second total mass by using a second mass attachment 44 at each predetermined mass attachment location 24. The device could further be set at additional total mass configurations using combinations of first 44 and second 46 mass attachments 40. Thus, the total mass of the device 10 can be adjusted without changing the shape of the device 10, or the location of the device 10 with respect to the gun barrel.

Additional total mass configurations can be used wherein mass attachments 40 are omitted from at least one predetermined mass attachment location 24.

Additional embodiments of the device 10 can use any number of different mass attachments 40, wherein any number of mass attachments 40 being used can have a different mass than others.

Each mass attachment location 24 can comprise a mating portion 26 (see FIG. 3) arranged to mate with a complimentary mating portion 42 of a mass attachment 40. The mating portion 26 and complimentary mating portion 42 engage one another to secure the mass attachment 40 at/in/on the mass attachment location 24. In some embodiments, the mating portion 24 and the complimentary mating portion 42 comprise threads, for example as shown in FIG. 3; however, any suitable engagement/mating mechanism can be used, such as friction-fitting, elastic materials compressed between a mass attachment 40 and the body portion 20, external retaining rings or other mechanisms described below.

In some embodiments, a mass attachment 40 is engaged to a mass attachment location 24 via said mating/engagement portions and via a damping mechanism 58. A damping mechanism 58 can comprise any suitable mechanism for damping movement of the mass attachment 40 relative to the mass attachment location 24, such as a resilient or elastomeric material positioned between the mass attachment 40 and the body portion 24. In some embodiments, a damping mechanism 58 comprises an o-ring 60, as shown in FIGS. 2 and 3.

In some embodiments, a mass attachment 40 or a mass attachment location 24 can be provided with a receiving area 48 for receiving a damping mechanism 58. In various embodiments, a receiving area 48 can comprise a stop, protrusion, groove, channel or other surface feature that will engage the damping mechanism 58. As shown in FIGS. 2 and 3, the receiving area 48 can comprise a groove formed in an outer surface of a mass attachment 40.

Figure 3:
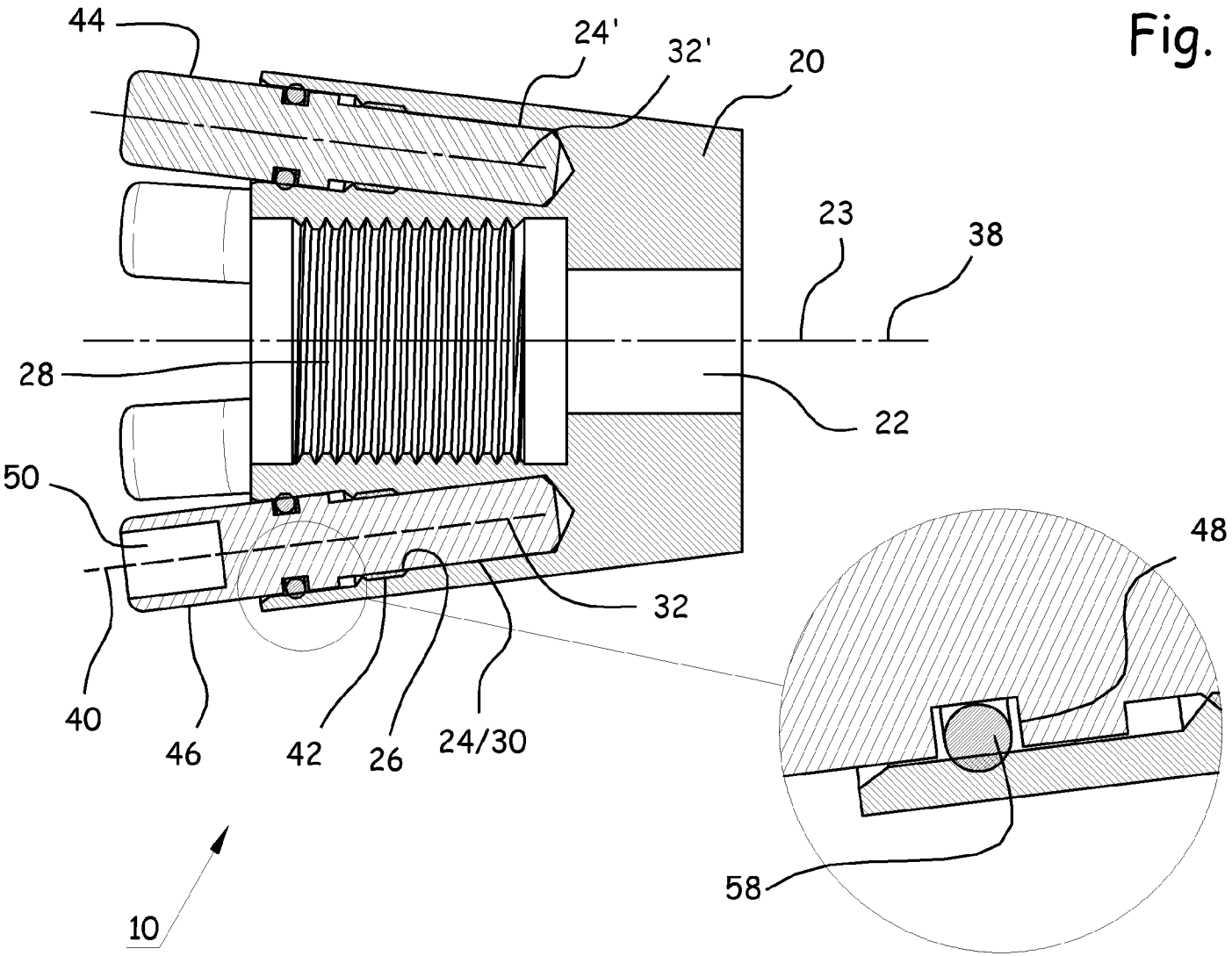
FIG. 3 shows a cross-sectional view of an embodiment of a mass tuning device.

FIG. 3 shows a cross-sectional view of an embodiment of a mass tuning device 10 wherein mass attachment locations 24 comprise cavities 30. Each mass attachment location 24 can comprise a longitudinal axis 32.

In various embodiments, the longitudinal axis 32 of a mass attachment location 24 can have any suitable orientation. In some embodiments, a longitudinal axis 32 can be parallel to the central axis 38 of the body portion 20. In some embodiments, a longitudinal axis 32 can be non-parallel to the central axis 38 of the body portion 20. As shown in FIG. 3, the longitudinal axes 32 can flare outwardly, which can allow the mass attachments 40 to be positioned more easily.

In some embodiments, a first mass attachment location 24 can define a first longitudinal axis 32, and a second mass attachment location 24' can define a second longitudinal axis 32'. Each longitudinal axis 32, 32' can be non-parallel to the central axis 38 of the body portion 20. The longitudinal axes 32, 32' can further be non-parallel to one another. In some embodiments, a first mass attachment location 24 can comprise a mirror image of a second mass attachment location 24' taken across the central axis 38 of the body portion 20 or the axis 23 of the bore 22.

In some embodiments, a longitudinal axis 32 can be orthogonal to the central axis 38 of the body portion 20, for example extending in a radial direction of the body portion 20. The mass attachments 40 can then be attached/detached via movement in a radial direction of the body portion 20. This configuration can be desirable because the blast and recoil forces are largely in the axial direction of the barrel. Thus, the blast and recoil forces applied to the device 10 during firing are largely oriented orthogonal to the attachment/detachment direction, providing greater stability of the mass attachments 40 with respect to the body portion 20. Radially oriented mass attachments 40 can also be secured using an external band, such as an elastic band or quick release ring that extends around the mass attachments 40.

Figure 4:
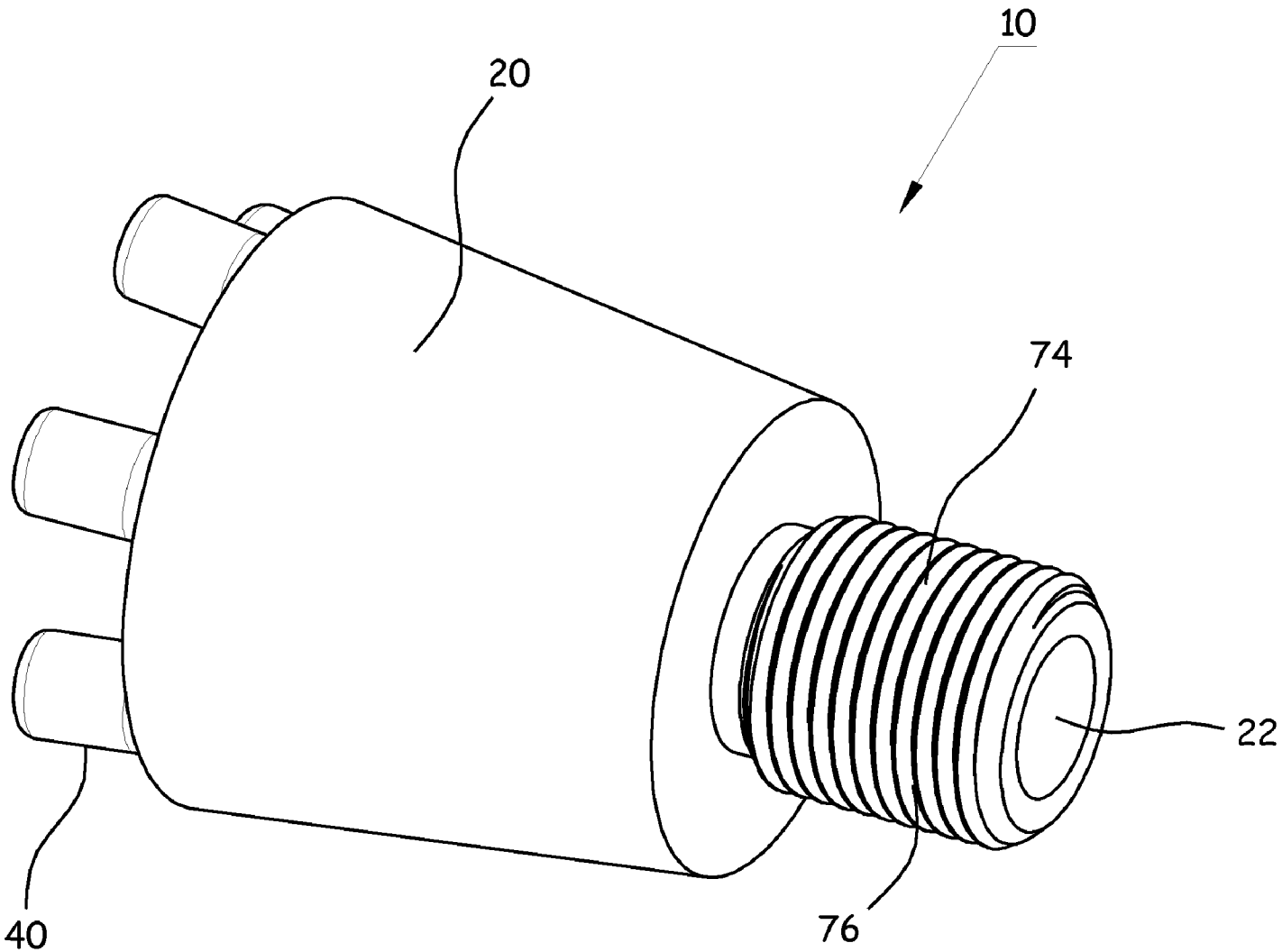
FIG. 4 shows an embodiment of a mass tuning device, configured to receive an accessory.

FIG. 4 shows another embodiment of a mass tuning device 10 that comprises an accessory engagement portion 74. In some embodiments, the bore 22 extends through the accessory engagement portion 74. In some embodiments the accessory engagement portion 74 comprises threads 76 that can engage complimentary threads on an accessory (not shown). An accessory can comprise any suitable device installed at the end of a gun barrel, such as a flash, sound or shock suppressor, muzzle brake, bayonet attachment, etc.

Figure 5:
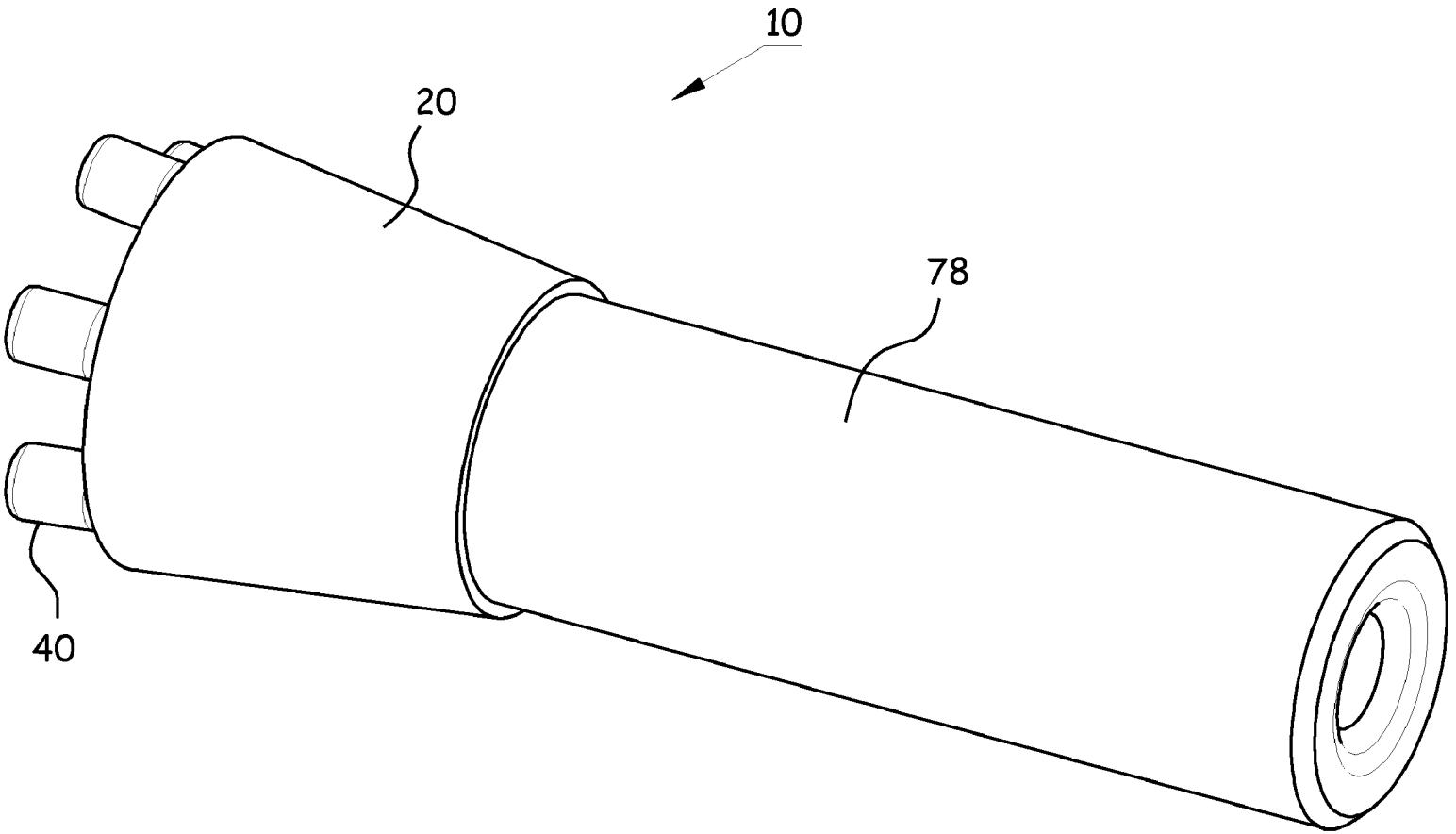
FIG. 5 shows an embodiment of a mass tuning device, wherein an accessory is integrated into the device.

FIG. 5 shows another embodiment of a mass tuning device 10 that comprises an integral accessory 78. An integral accessory 78 can comprise any of the accessories disclosed herein, integrated into the device 10, for example integrated into the body portion 20. In some embodiments, the body portion 20 comprises a recoil and blast dissipater, and can include features disclosed in U.S. Pat. No. 7,143,680, the entire disclosure of which is hereby incorporated herein by reference.

Figure 6:
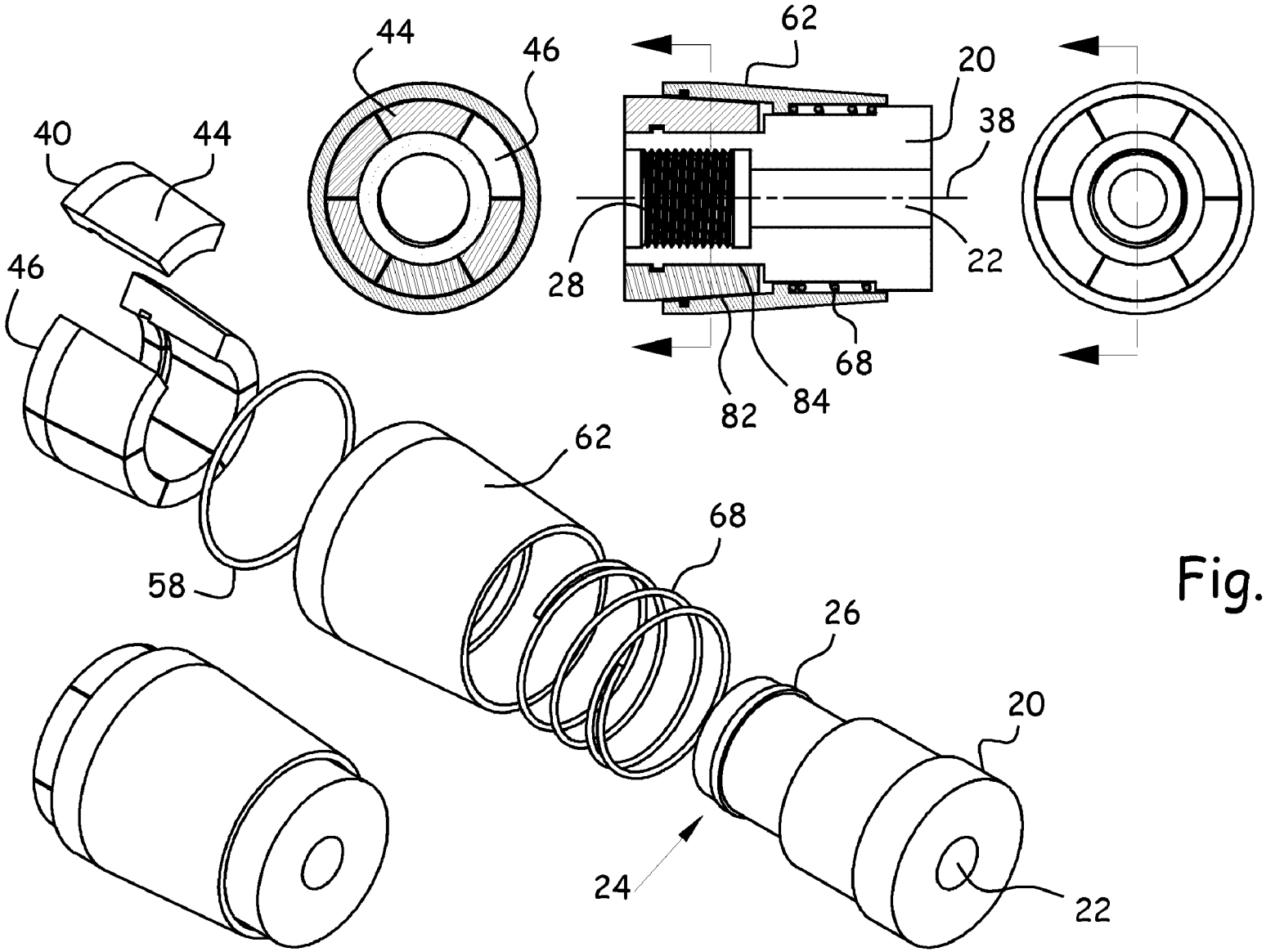
FIG. 6 shows multiple views of an embodiment of a mass tuning device.

FIG. 6 shows another embodiment of a mass tuning device 10. In some embodiments, the predetermined mass attachment locations 24 can comprise one or more protrusions 34 that extend from the body portion 20. A protrusion 34 can comprise an engagement portion 26 that is configured to engage a mass attachment 40, and can be a post, a flange or other suitable shape. A complimentary engagement portion 42 of a mass attachment 40 can comprise a groove, channel, cavity or the like, sized to engage the protrusion 34.

A plurality of mass attachments 40 can form an annular ring that can be positioned around the body portion 20. Any suitable number of mass attachments 40 can form an annular ring.

In some embodiments, the body portion 20 can be configured to receive a predetermined number of the partial-ring mass attachments 40. Thus, the body portion 20 can comprise additional protrusions (not shown), such as stop tabs, that are shaped and located to prevent the mass attachments from moving with respect to the body portion 20, for example in a direction around a circumference of the body portion 20.

In the embodiment shown in FIG. 6, an engagement mechanism can comprise a collar 62. A portion of the collar 62 can be oriented around the body portion 20 and can be in contact with the body portion 20. Desirably, the contact can prevent the collar 62 from displacing laterally with respect to the body portion 20. A portion of the collar 62 can extend around the mass attachments 40, and can engage the mass attachments 40, applying an inward force and securing them in place. As shown in FIG. 6, a mass attachment 40 can comprise a surface in contact with the body portion 20 and a surface in contact with the collar 62. In some embodiment, the surfaces may be opposite one another, wherein the body portion 20 and collar 62 work to clamp the mass attachment 40. The surfaces can also be oriented nonparallel to one another, and the collar 62 can comprise a surface 82 that is nonparallel to a surface 84 of the body portion 20. For example, an inner surface 82 of the portion of the collar 62 that engages the mass attachments 40 can be non-parallel to the central axis 38 of the body portion 20. In some embodiments, the device 10 can further include a biasing member 68, such as a spring, which biases the collar 62 toward the mass attachments 40. This biasing force, combined with the inner surface 82 of the collar 62, load against the mass attachments 40 and secure them in place.

In some embodiments, a damping mechanism 58 can also be positioned between the collar 62 and the mass attachments 40. As shown in FIG. 6, a damping mechanism 50 can be an o-ring.

Figure 7A:
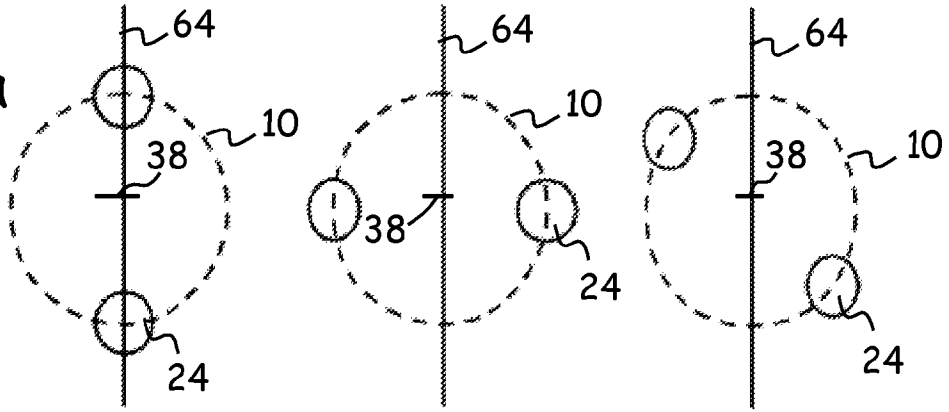
FIGS. 7*a*-7*d* show possible orientations of various embodiments of a mass tuning device.
Figure 7B:
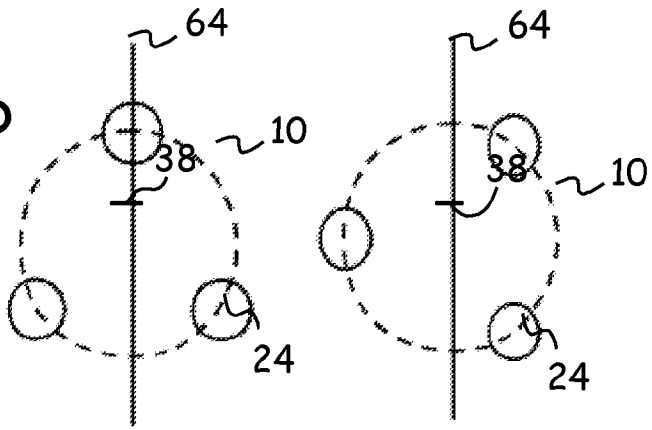
Figure 7C:
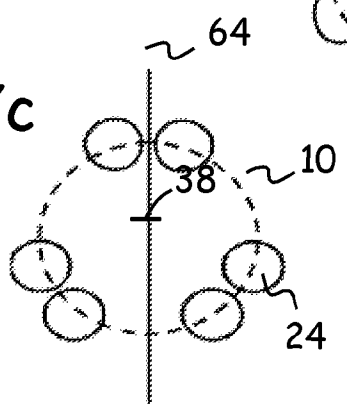

FIGS. 7*a*-7*c* show embodiments of a device 10, illustrating some examples of possible mass attachment location 24 options.

FIG. 7*a* shows an embodiment having two mass attachment locations 24, at three different orientations. The two mass attachment locations 24 are located opposite one another across the central axis 38 of the device 10. In a first orientation, the mass attachment locations 24 are both centered on the vertical axis 64. In a second orientation, the mass attachment locations 24 comprise mirror images of one another across the vertical axis 64. In a third orientation, the mass attachment locations 24 are not symmetrical across the vertical axis 64. Although the device 10 will function in the third orientation, the first and second orientations are preferred due to greater overall symmetry.

FIG. 7*b* shows an embodiment having three mass attachment locations 24, at two different orientations. The three mass attachment locations 24 are equally spaced around the central axis 38 of the device 10. In a first orientation, one mass attachment location 24 is centered on the vertical axis 64, and the other two mass attachment locations 24 are mirror images of one another across the vertical axis 64. In a second orientation, the mass attachment locations 24 are not centered on the vertical axis 64, and are not mirrored across the vertical axis 64. Although the device 10 will function in the second orientation, the first orientation is preferred due to greater overall symmetry.

FIG. 7*c* shows an embodiment having six mass attachment locations 24. The mass attachment locations 24 are grouped in pairs, and each pair is centered 120° apart from the other pairs. One pair is centered on the vertical axis 64, such that one mass attachment location 24 of the pair is a mirror image of the other mass attachment location 24. The other two pairs are positioned such that the mass attachment locations 24 of one pair comprise mirror images of the mass attachment locations 24 of the other pair, taken across the vertical axis 64. This embodiment is desirable due to overall symmetry, and is an example of a preferred embodiment of a device 10 having an even number of mass attachment locations 24 that are not equally spaced around the central axis 38. Other rotational orientations of this embodiment may be less desirable than the orientation illustrated in FIG. 7*c*.

Figure 7D:
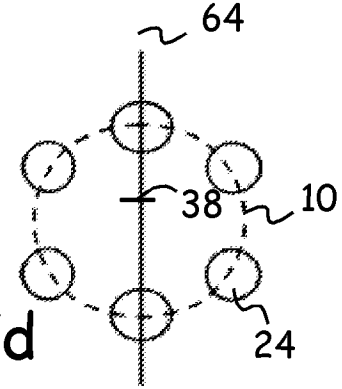

FIG. 7*d* shows an embodiment having an even number of mass attachment locations 24 that are equally spaced around the central axis 38. This orientation is preferred, as the device 10 is symmetrical across the vertical axis 64, and each mass attachment location 24 is mirrored across the central axis 38.

The mass tuning device 10 disclosed herein is desirable because the mass adjustment is not related to rotational orientation of the device, and further because adjustment of the mass will not change the location of the body portion 20 with respect to the barrel 70 (see FIG. 1). The rotational orientation can be set by securing the device 10 to the firearm barrel 70, for example using complimentary threads 28, 72. The body portion 20 is then locked in place with respect to the barrel 70, and the body portion 20 will not move with respect to the barrel 70 when the total mass of the device 10 is adjusted.

Separation of the barrel mounting features and the mass adjustment features makes the present mass tuning device 10 very robust. It is therefore able to withstand repeated firing of high-power ammunition, such as 50 caliber BMG rounds, without deterioration of its fine mass tuning capabilities. It is also better able to withstand impact and other unexpected loads, such as from dropping the firearm or other impacts experienced in combat, without degradation in performance.

In some embodiments, the body portion 20 can comprise a plurality of posts, for example extending outwardly from the body portion 10. In some embodiments, the posts can be radially oriented. Mass attachments 40 can comprise a cavity, and the cavity can engage a post.

In some embodiments, the body portion 20 can comprise a plurality of grooves or indentations in its outer surface, such as v-grooves or squared-off channels. Each groove can define a mass attachment location 24. The mass attachments 40 can be secured in place using independent or common securement features.

An example of independent securement features would be a positionable member, such as an arm or clamp, provided for each mass attachment 40. For example, a positionable member can be hingedly attached to the body portion 20 and moveable between locked and unlocked positions. An example of a common securement feature would be a band or ring that extends around the device 10 and secures all of the mass attachments simultaneously.

In some embodiments, the body portion 20 can comprise a plurality of non-cylindrical cavities, such as conical cavities or cavities having a non-circular cross-sectional shape. Each cavity can define a mass attachment location 24. The mass attachments 40 can also be cooperatively shaped, such that a cross-section of a mass attachment 40 is similar to a cross-sectional shape of the cavity. The mass attachments can be secured in place using independent or common securement features.

A firearm barrel is typically a cantilevered support member that is rigidly supported at one end by the receiver/body portion of the firearm. As a cantilever, the unsupported end of the barrel is generally displaced downwardly when compared to the supported end, for example due to gravity. The displacement/sag is generally not visible to the naked eye, but it does impact performance of the rifle. When the rifle is fired, rapidly expanding pressurized gasses force the bullet down the barrel. The pressure of the expanding gasses behind the bullet causes the barrel to distort as the bullet travels down the barrel. The distortions can include slight increases in the barrel diameter and length behind the bullet, as well as a transverse "whip." As the hot, pressurized gasses and the bullet travel down the barrel, the barrel elongates slightly at locations behind the bullet. As the bullet travels farther down the barrel, the elongation builds. The barrel distortions, combined with the barrel sag, creates a "whip mode" that can move the unsupported end of the barrel. When it finally begins to move, it accelerates due to the earlier barrel displacement/elongation and due to forces applied to the barrel by the accelerating bullet. This interaction sets up a dynamic motion not unlike the cracking of a whip. The time at which the bullet leaves the barrel is that barrel's terminal aim at the target.

Another dynamic displacement present in the barrel is an annular soundwave, or strain wave that travels up and down the barrel. Upon the initial detonation of the propellant, a soundwave travels through the barrel material very quickly, and much faster than the bullet. The soundwave reflects back and forth between the two ends of the barrel as the bullet travels down the barrel. The soundwave also causes a slight increase in barrel diameter in the immediate vicinity of the soundwave. If the bullet exits the muzzle at the same time that the soundwave is positioned at the muzzle, trajectory of the bullet can be thrown off even if the barrel's terminal aim is directly at the target.

Still another dynamic displacement mode is torsion, a twisting of the barrel about its central axis. This occurs when the bullet is accelerated down the barrel. The bullet is rotated about its central axis by its engagement with rifling in the barrel. The force imparted to the bullet to cause its rotation by the rifling also causes an equal reaction force on the barrel about its central axis, causing torsion, a barrel twist that springs back to the neutral position after the bullet exits the barrel.

All of the above-related dynamic displacements in the barrel combine in very complex ways. The most pronounced displacement and the one that occurs at the lowest speed, relative to the other displacement modes, putting the barrel in the mode of lowest resonance once the bullet leaves the barrel muzzle, is the transverse bending mode, or barrel "whip" mode. It is this incipient mode, which is most easily modified by the mass tuning device 10.

The mass tuning device 10 disclosed herein uses a predetermined total mass to change the vibration mode of the barrel muzzle displacement during the firing event. Tuning the device 10 alters the barrel's end-mass, which changes the time and magnitude of the barrel's muzzle whip to reduce the deflection of the barrel's terminal aim point during the finite time period of bullet exit. The total mass can be adjusted to reduce inaccuracies caused by barrel whip and shock forces, thereby increasing precision of the firearm. Any combination of mass attachments 40 can be used to set the total mass of the system as desired.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An apparatus for mass-tuning a gun barrel comprising:

a body portion configured for attachment to a gun barrel, the body portion having a main bore therethrough, the body portion further defining a plurality of predetermined mass attachment locations, each mass attachment location comprising a mating portion configured to engage a complimentary mating portion of a mass attachment, wherein said mass attachment locations are not in direct fluid communication with said main bore.

2. The apparatus of claim 1, further comprising a plurality of mass attachments, each mass attachment positioned at one of said predetermined mass attachment locations.

3. The apparatus of claim 2, wherein a first mass attachment comprises a greater mass than a second mass attachment.

4. The apparatus of claim 3, comprising more mass attachments than mass attachment locations, wherein different combinations of mass attachments allow the mass of the apparatus to be adjusted without changing the shape or location of the apparatus.

5. The apparatus of claim 2, wherein a first mass attachment and a second mass attachment have the same shape but different masses or densities.

6. The apparatus of claim 2, wherein a first mass attachment comprises a first shape and a second mass attachment comprises a second shape, wherein a complimentary mating portion of the first shape is similar to a complimentary mating portion of the second shape.

7. The apparatus of claim 2, wherein each mass attachment is engaged to a predetermined mass attachment location via said complimentary mating portion and a damping mechanism.

8. The apparatus of claim 7, wherein said complimentary mating portion comprises a threaded surface.

9. The apparatus of claim 7, wherein said damping mechanism comprises an o-ring disposed between a surface of said mass attachment and a surface of said body portion.

10. The apparatus of claim 2, further comprising a collar, a portion of the collar extending around said mass attachments.

11. The apparatus of claim 10, further comprising a biasing member positioned between a portion of said body and a portion of said collar.

12. The apparatus of claim 1, wherein said predetermined mass attachment locations are equally distributed around a central axis of the body portion.

13. The apparatus of claim 1, comprising at least four of said predetermined mass attachment locations.

14. The apparatus of claim 1, wherein each predetermined mass attachment location comprises a cavity in the body portion.

15. The apparatus of claim 14, further comprising a plurality of mass inserts, each mass insert positioned at least partially within one of said cavities.

16. The apparatus of claim 15, wherein a cross-sectional shape of the first cavity comprises a mirror image of a cross-sectional shape of the second cavity taken across a central axis of the main bore.

17. The apparatus of claim 14, wherein a first cavity defines a first cavity central axis and a second cavity defines a second cavity central axis, the first cavity central axis non-parallel to the second cavity central axis.

18. The apparatus of claim 1, further comprising a first plurality of mass attachments and a second plurality of mass attachments, the first plurality of mass attachments comprising a number of mass attachments at least equal to the number of predetermined mass attachment locations, the second plurality of mass attachments comprising a number of mass attachments at least equal to the number of predetermined mass attachment locations, wherein the mass attachments of the first plurality comprise a different mass than the mass attachments of the second plurality.

19. The apparatus of claim 1, wherein the body portion comprises a muzzle brake, silencer, flash suppressor or bayonet attachment.

20. The apparatus of claim 1, wherein said body portion comprises an annular retention feature arranged to engage a complimentary annular retention feature on a gun barrel.

21. The apparatus of claim 1, wherein said mating portion comprises a raised flange or a recess.

22. A device for attachment to a firearm comprising:

a body portion having a passageway extending therethrough, the body portion defining a plurality of mass attachment locations;

a plurality of mass elements, each mass element positioned at a mass attachment location; and a retaining collar, at least a portion of said retaining collar extending around said mass elements and retaining the position of said mass elements;

wherein said mass attachment locations are not in direct fluid communication with said passageway.

* * * * *